US006721998B2

(12) United States Patent
Többen

(10) Patent No.: US 6,721,998 B2
(45) **Date of Patent: *Apr. 20, 2004**

(54) AIR FLOW REGULATING DEVICE IN A FIBER PROCESSING MACHINE

(75) Inventor: Robert Többen, Mönchengladbach (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 0 days.

This patent is subject to a terminal disclaimer.

(21) Appl. No.: 10/146,120

(22) Filed: May 16, 2002

(65) Prior Publication Data

US 2002/0133912 A1 Sep. 26, 2002

Related U.S. Application Data

(63) Continuation of application No. 10/079,261, filed on Feb. 21, 2002, now abandoned.

(30) Foreign Application Priority Data

Mar. 7, 2001 (DE) ..... 101 10 824

(51) Int. Cl.[7] ..... D01G 15/00

(52) U.S. Cl. ..... 19/98; 19/107; 19/200; 19/203

(58) Field of Search ..... 19/65 A, 65 R, 19/98, 99, 100, 101, 105, 106 R, 107, 108, 109, 112, 200, 202, 203, 204, 205; 209/146, 149

(56) References Cited

U.S. PATENT DOCUMENTS

| | | | | |
|---|---|---|---|---|
| 4,815,170 A | | 3/1989 | Portell | |
| 5,095,584 A | * | 3/1992 | Temburg | 19/107 |
| 5,862,573 A | * | 1/1999 | Leifeld | 19/105 |
| 6,145,166 A | | 11/2000 | Waeber et al. | |
| 6,516,497 B2 | * | 2/2003 | Farber et al. | 19/200 |
| 6,568,037 B2 | * | 5/2003 | Leder et al. | 19/98 |

FOREIGN PATENT DOCUMENTS

| | | |
|---|---|---|
| DE | 26 13 844 | 4/1977 |
| DE | 37 33 094 | 4/1989 |
| DE | 39 02 202 | 8/1990 |
| DE | 0 909 843 | 4/1999 |
| DE | 199 23 420 | 11/2000 |
| DE | 200 22 293 U1 | 1/2002 |
| GB | 2 228 495 A | 8/1990 |
| GB | 2 371 566 A | 7/2002 |

* cited by examiner

*Primary Examiner*—Gary L. Welch
(74) *Attorney, Agent, or Firm*—Venable LLP; Robert Kinberg; Stuart I. Smith

(57) ABSTRACT

A fiber processing machine includes a roll having a direction of rotation and a clothing for carrying thereon fiber material; a cover partially circumferentially shrouding the roll; an air passage opening provided in the cover; an air guiding element bordering the air passage opening; a support for movably holding the air guiding element for varying a distance between the roll and the air guiding element; a pressure sensor for measuring a static pressure between the cover and the roll; and an arrangement for setting a position of the air guiding element as a function of the pressure measured by the pressure sensor.

10 Claims, 6 Drawing Sheets

AIR FLOW REGULATING DEVICE IN A FIBER PROCESSING MACHINE

CROSS REFERENCE TO RELATED APPLICATIONS

This application is a continuation of application Ser. No. 10/079,261 filed Feb. 21, 2002, now abandoned.

This application claims the priority of German Application No. 101 10 824.9 filed Mar. 7, 2001, which is incorporated herein by reference.

BACKGROUND OF THE INVENTION

This invention relates to a device incorporated in a fiber processing machine such as a card, a cleaner, an opener or the like for cleaning, for example, cotton or chemical fibers. The fiber processing machine includes a rapidly rotating roll shrouded by a cover (composed of cover elements) provided with at least one air passage opening. The air passage opening is, at its downstream end as viewed in the direction of roll rotation, bordered by an air guiding element whose distance from the roll is variable.

In a known device the distance of the air guiding element from the roll is variable as a function of the removed quantities of waste such as trash, dust, fragments and the like.

SUMMARY OF THE INVENTION

It is an object of the invention to provide an improved device of the above-outlined type.

This object and others to become apparent as the specification progresses, are accomplished by the invention, according to which, briefly stated, the fiber processing machine includes a roll having a direction of rotation and a clothing for carrying thereon fiber material; a cover at least partially circumferentially shrouding the roll; an air passage opening provided in the cover; an air guiding element bordering the air passage opening; a support for movably holding the air guiding element for varying a distance between the roll and the air guiding element; a pressure sensor for measuring a static pressure between the cover and the roll; and an arrangement for setting a position of the air guiding element as a function of the pressure measured by the pressure sensor.

As a result of the measures according to the invention, an optimization of the working elements at the roll is feasible. In particular, an optimization at the separating elements, for example, separating knives is achieved with the aid of the air quantities and/or air stream, such as a pneumatic or a vacuum stream. It is a further advantage of the invention that in a simple manner additional air removal quantities and devices required therefor may be dispensed with because the air quantities exciting through air passage openings from regions where higher than atmospheric pressure (overpressure) prevails, may be introduced or drawn in through air passage openings provided in the vacuum zone.

DESCRIPTION OF THE PREFERRED EMBODIMENTS

Figure 1:
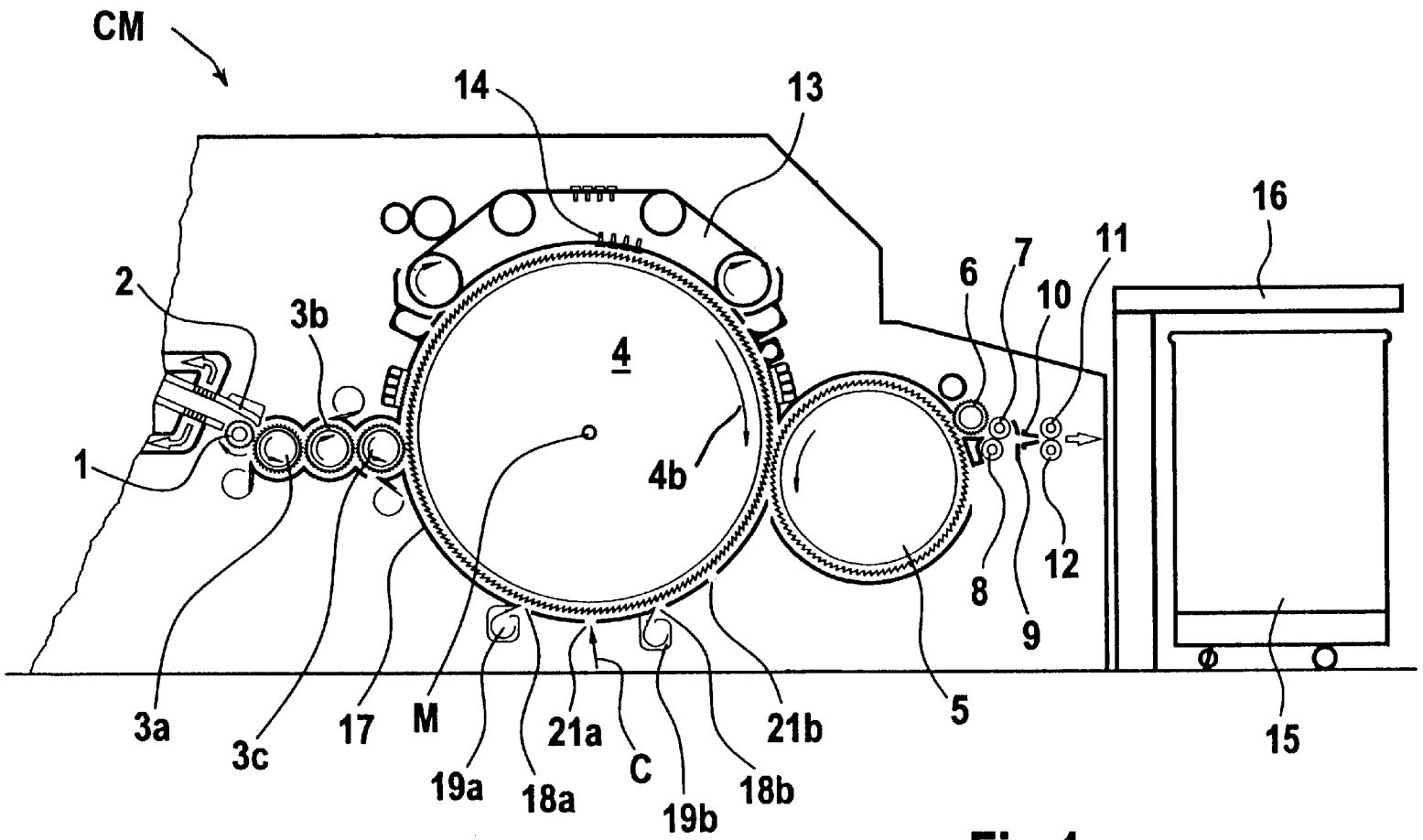
FIG. 1 is a schematic side elevational view of a carding machine incorporating the invention.

FIG. 1 shows a carding machine CM which may be, for example, a high-performance DK 903 model, manufactured by Trützschler GmbH & Co. KG, Mönchengladbach, Germany. The carding machine CM has a feed roller 1, a feed table 2 cooperating therewith, licker-ins 3*a*, 3*b*, 3*c*, a main carding cylinder 4 rotating in the direction 4*b* about the cylinder axis M, a doffer 5, a stripping roll 6, crushing rolls 7, 8, a web guiding element 9, a web trumpet 10, calender rolls 11, 12, a traveling flats assembly 13 having flat bars 14, a coiler can 15 and a sliver coiler 16.

Underneath the cylinder 4, between the doffer 5 and the licker-in 3*c*, a cylinder cover 17 is disposed which has two waste outlet openings 18*a* and 18*b* leading into respective suction chambers 19*a* and 19*b*. The waste outlet openings 18*a* and 18*b* are preceded—as viewed in the direction of rotation 4*b* of the cylinder 4—by an air inlet opening 21*a* and an air outlet opening 21*b*, respectively.

Figure 2A:
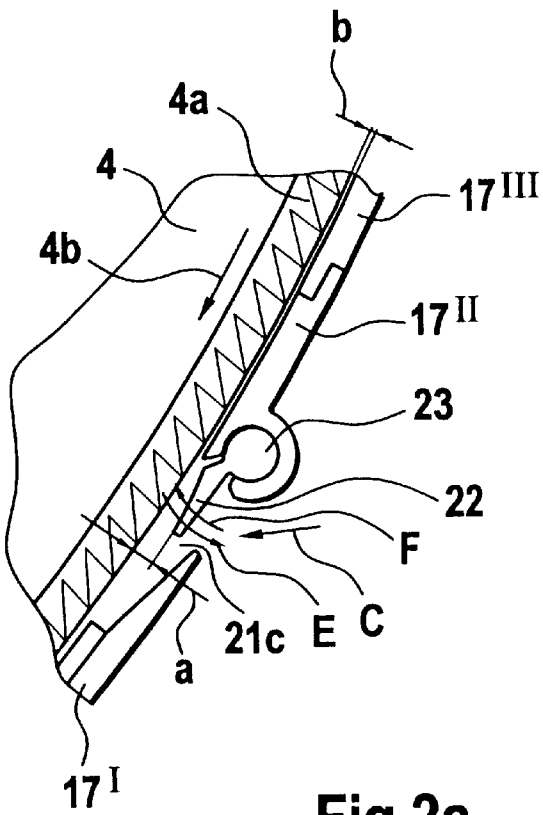
FIG. 2*a* is an enlarged detail of FIG. 2.
Figure 2:
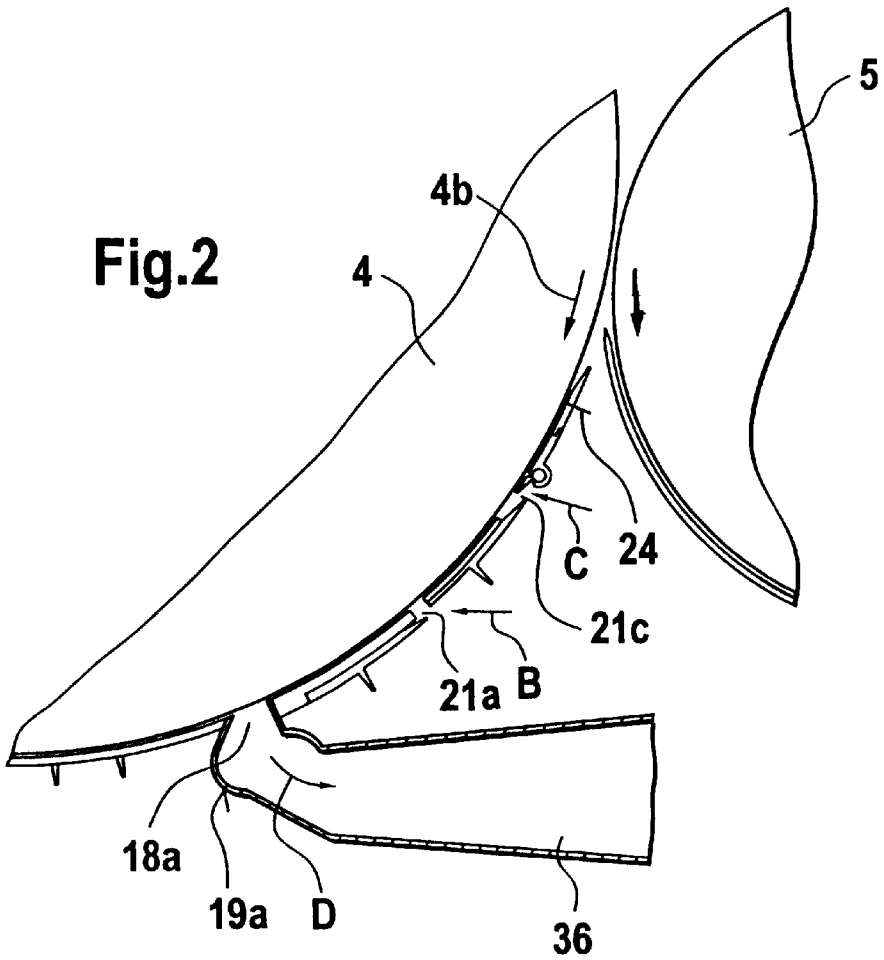
FIG. 2 is a fragmentary schematic side elevational view of a carding cylinder and a doffer, showing an embodiment of an adjustable air intake opening.

Turning to FIGS. 2 and 2*a*, the cover 17 is composed of a plurality of cover elements $\mathbf{17}^{I}$, $\mathbf{17}^{II}$, $\mathbf{17}^{III}$. The waste outlet opening 18*a* is preceded by the air inlet opening 21*a* and a further air inlet opening 21*c*. While a non-regulated air stream B enters from the atmosphere through the air inlet opening 21*a*, an air stream C which enters through the air inlet opening 21*c* is regulated. For this purpose an air guiding element 22 (air guiding vane) is provided which has a cylindrical bearing head 23 held in the cover part $\mathbf{17}^{II}$ for rotation in the direction of the arrows E, F. The other end of the air guiding element 22 is oriented in the rotary direction 4*b* of the cylinder 4. By virtue of this arrangement the flow passage of the air inlet opening 21*c* may be gradually widened or narrowed.

Figure 3:
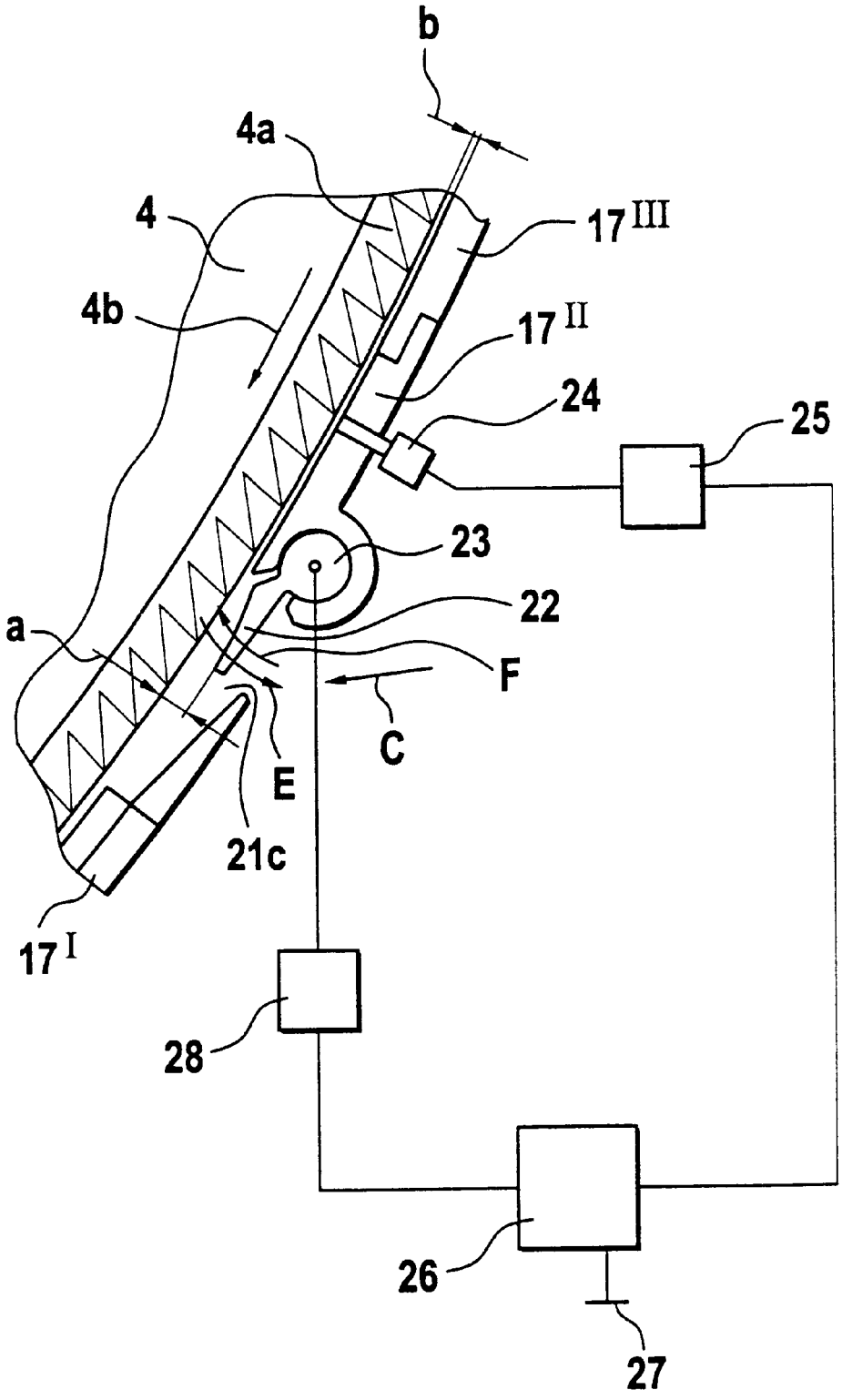
FIG. 3 is a view similar to FIG. 2*a* showing, in addition, a block diagram of a regulating device having a pressure sensor, a regulator and a setting member.

The air inlet opening 21*c* is preceded by a pressure measuring element 24 with which the static air pressure underneath the cylinder cover 17 (that is, in the clearance b between the cover 17 and the cylinder clothing 4*a*) is measured. For this purpose a through bore is provided in the cover 17. The pressure values are used for setting the distance a of the air guiding vane 22 from the points of the cylinder clothing 4*a*. The setting of the position of the air guiding vane 22 may be effected manually in a manner not shown. Also, the position of the air guiding vane 22 may be, as shown in FIG. 3, automatically set as a function of the measured values of the pressure sensor 24. For this purpose the pressure sensor 24 is associated with a transducer 25 which converts the pressure values into electric signals. The transducer 25 is connected to a regulator 26 (such as a microcomputer), having a desired value setter 27. The regulator 26 is connected via a setting device, for example, a stepping motor, 28 with the air guiding element 22. In the regulator 26 actual pressure values are compared with nominal pressure values and, in case of a deviation, signals representing such a deviation are applied to the motor 28.

During operation, through the air inlet openings 21*a* and 21*c*, respective air streams B and C are drawn from the atmosphere by means of the vacuum prevailing in the gap between the cylinder cover 17 and the surface of the cylinder 4. The air streams B and C impinge on the short fibers carried by the cylinder clothing 4*a* and loosen the hold of the clothing 4*a* on such short fibers. Thereafter, the short fibers are drawn through the waste outlet opening 18*a* into the suction chamber 19*a* and are removed via a conduit 36 which is coupled to a non-illustrated vacuum source. By means of the inflowing air streams B and C which exert a pressure on the short fibers and the vacuum stream D which exerts a pulling force on the short fibers, the removal force on the short fibers is greater than the retaining force of the cylinder clothing 4*a*. In this manner, the short fibers are removed from the cylinder clothing to a greater extent than the long fibers still present on the cylinder clothing.

Figure 4:
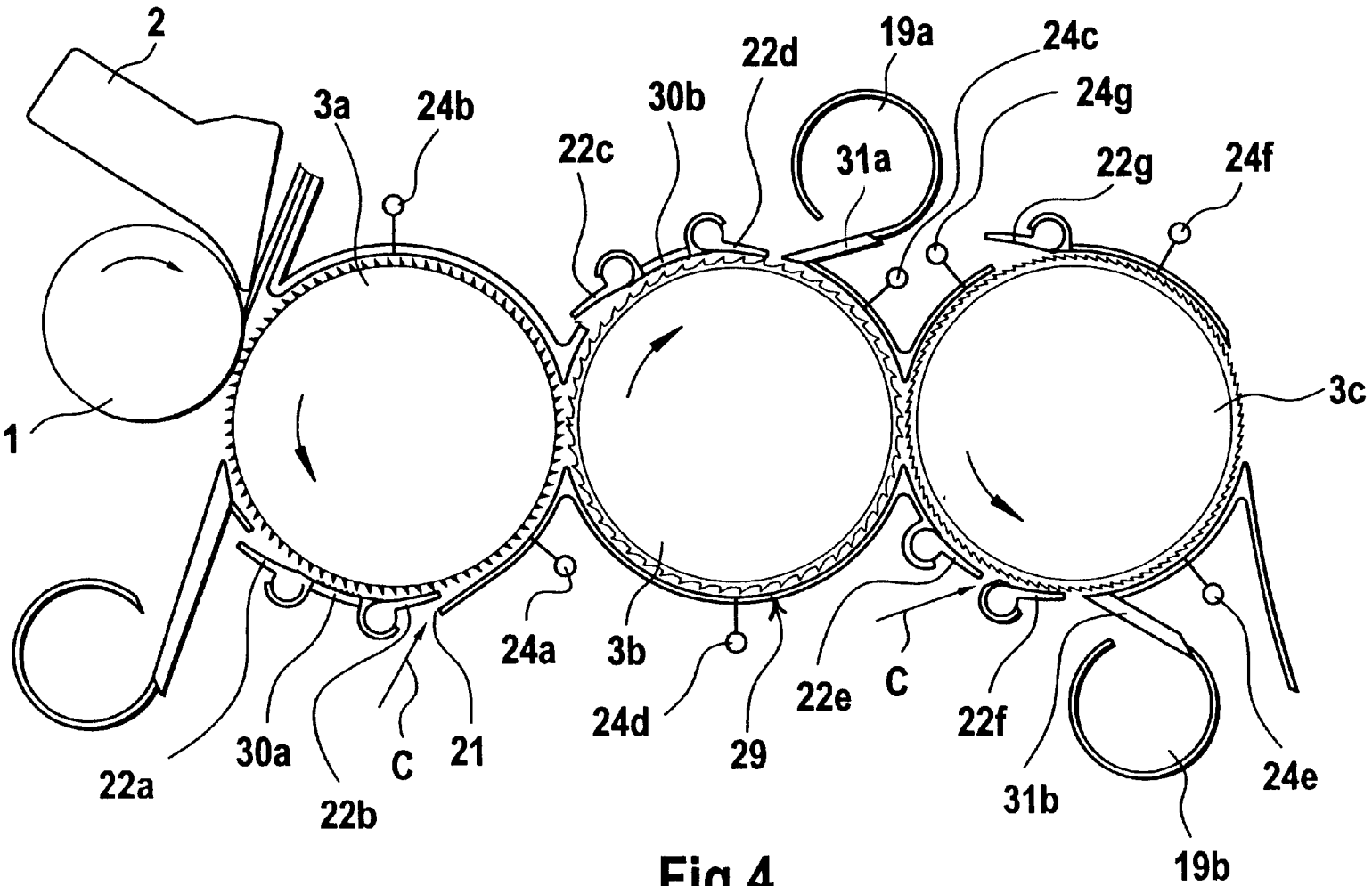
FIG. 4 is a schematic side elevational view of licker-ins of a carding machine, provided with pressure sensors, air passage openings and air guiding elements.

Turning to FIG. 4, the three licker-ins 3*a*, 3*b* and 3*c* of a carding machine have a cover generally designated at 29. The cover 29 is interrupted by air passage openings, by material transfer locations between two cooperating rolls, by air guiding elements 22*a*–22*g*, separating knives 31*a*, 31*b* and stationary carding elements 30*a*, 30*b*. At various locations of the cover 29 pressure sensors 24*a*–24*g* are provided. The pressure sensors 24*a*–24*g* are connected to the regulating device 26 of FIG. 3.

Figure 5:
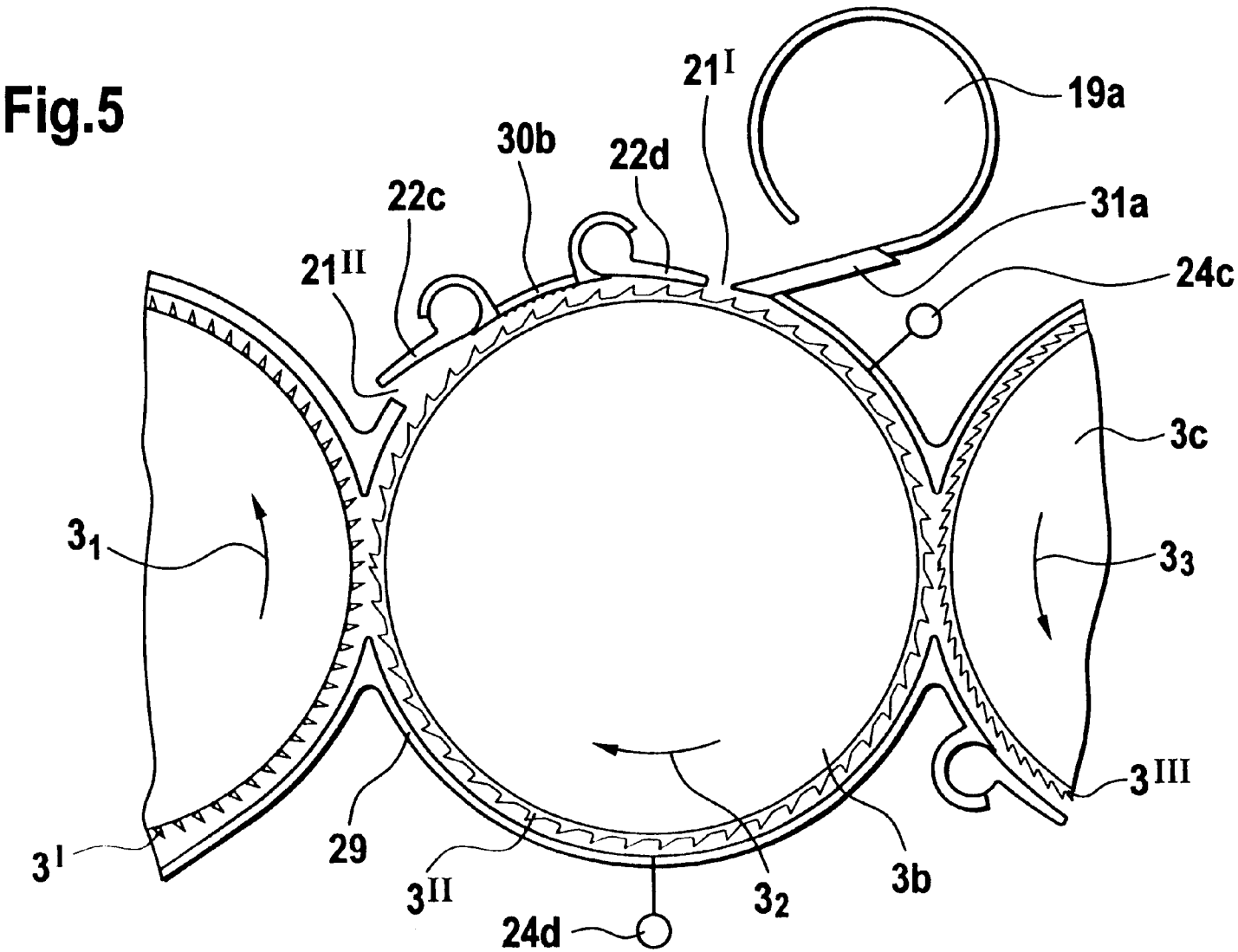
FIG. 5 is an enlarged detail of FIG. 4.

As shown in FIG. 5, the licker-in 3*a* has a clothing formed of needles $\mathbf{3}^{I}$ and rotating in the direction $\mathbf{3}_1$, the licker-in 3*b* has a relatively coarse sawtooth clothing $\mathbf{3}^{II}$ and rotates in the direction 32 and the licker-in 3*c* has a relatively fine sawtooth clothing $\mathbf{3}^{III}$ and rotates in the direction 33. The rapidly rotating licker-ins 3*a*, 3*b* and 3*c* have an increasing circumferential velocity in the direction of material feed, that is, from the left to the right as viewed in FIG. 5. At an air passage opening 121 provided in the cover 29 downstream of the stationary carding element 30*b* as viewed in the direction of rotation of the roll 3*b*, a vacuum prevails between the cover 29 and the roll clothing $\mathbf{3}^{II}$. At an air passage opening $\mathbf{21}^{II}$ provided in the cover 29 upstream of the stationary carding element 30*b* as viewed in the direction of rotation of the roll 3*b*, an overpressure prevails between the cover 29 and the roll clothing $\mathbf{3}^{II}$. The pressure sensor 24*c* provides for a measurement of the vacuum whereas the pressure sensor 24*d* provides for a measurement of the overpressure. Between the air guiding element 22*d* and the clothing $\mathbf{3}^{II}$ a vacuum prevails whereas between the air guiding element 22*c* and the clothing $\mathbf{3}^{II}$ an overpressure is present. By virtue of the vacuum, air enters through the air passage opening $\mathbf{21}^{1}$ from the outside into the intermediate space between the cover 29 and the clothing $\mathbf{3}^{II}$ whereas by virtue of the overpressure, air escapes outward through the air passage opening $\mathbf{21}^{II}$ which is drawn away through the suction hood 19*a*. In this manner the degree of separation of foreign particles such as trash and the like may be varied at the separating knives 31*a*, 31*b*.

Figure 6:
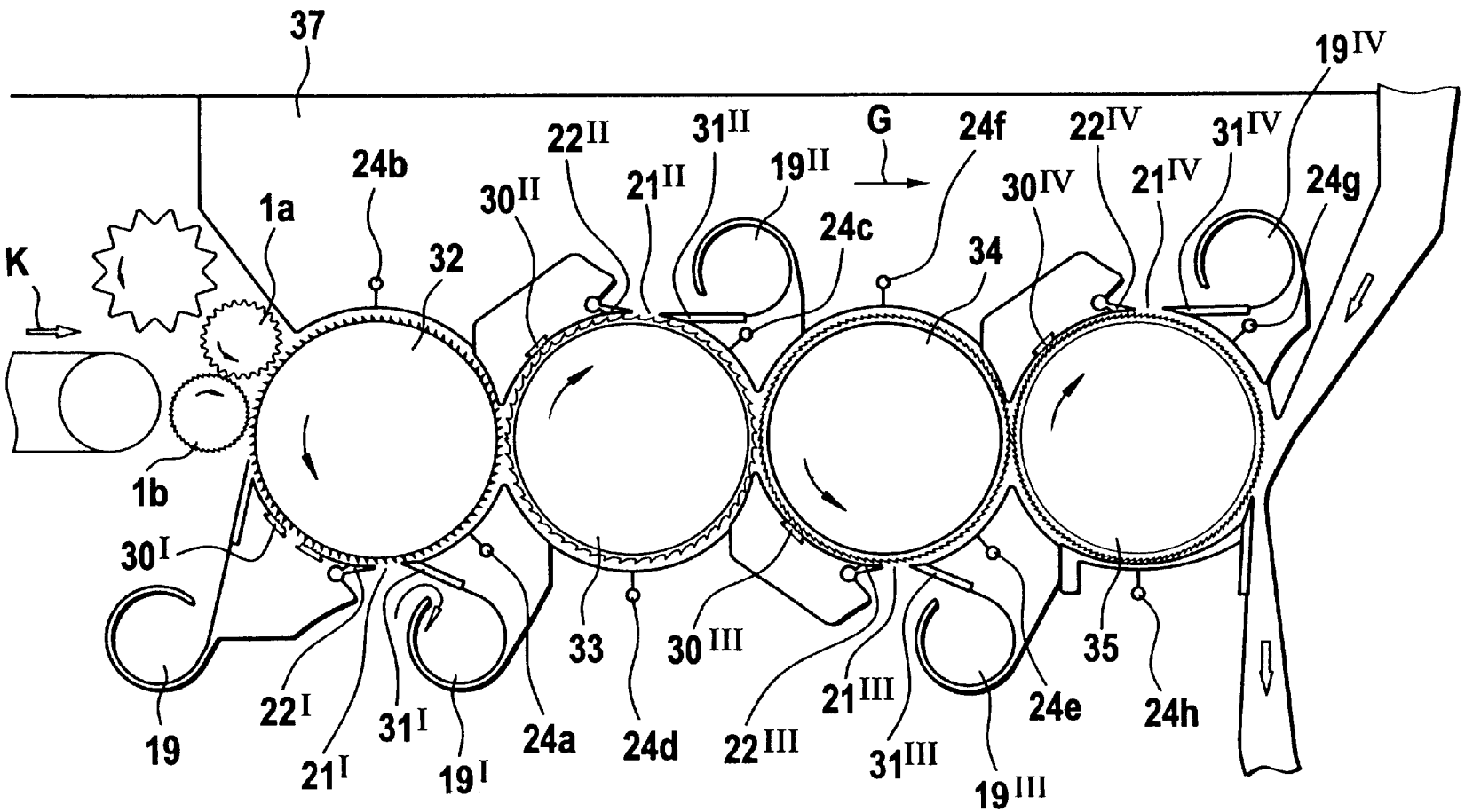
FIG. 6 is a schematic side elevational view of a cleaner incorporating the invention.

Turning to FIG. 6, in a cleaning assembly which is disposed in a closed housing 37 and which may be a CVT4 model manufactured by Trützschler GmbH & Co. KG, Monchengladbach, Germany, the fiber material to be cleaned, such as cotton, is supplied, as indicated by the arrow K, to the feed rollers 1*a*, 1*b* as fiber tufts. The feed rollers 1*a*, 1*b* clamp the fiber material and advance it to a pin roll 32 having a circumferential velocity of 10–21 m/sec. The pin roll 32 is followed by a sawtooth roll 33 which has a circumferential velocity of approximately 15–25 m/sec. The roll 33 is followed by additional sawtooth rolls 34 and 35. The rolls 32–35 have a diameter of approximately 150–300 mm.

The roll 32 cooperates with a stationary carding element $\mathbf{30}^{I}$, a settable air guiding element $\mathbf{22}^{I}$, an air outlet opening $\mathbf{21}^{I}$, a separating knife $\mathbf{31}^{I}$ and pressure sensors $\mathbf{24}^{a}$ and $\mathbf{24}^{b}$.

The roll 33 cooperates with a stationary carding element $\mathbf{30}^{II}$, a settable air guiding element $\mathbf{22}^{III}$, an air outlet opening $\mathbf{21}^{III}$, a separating knife $\mathbf{31}^{III}$ and a pressure sensor $\mathbf{24}^{d}$.

The roll 34 cooperates with a stationary carding element $\mathbf{30}^{IV}$, a settable air guiding element $\mathbf{22}^{IV}$, an air outlet opening $\mathbf{21}^{IV}$, a separating knife $\mathbf{31}^{IV}$ and pressure sensors $\mathbf{24}^{e}$ and $\mathbf{24}^{f}$.

The roll 35 cooperates with a stationary carding element $\mathbf{30}^{IV}$ a settable air guiding element $\mathbf{22}^{IV}$ an air outlet opening $\mathbf{21}^{IV}$, a separating knife $\mathbf{31}^{IV}$ and a pressure sensor 24*h*.

Respective suction hoods $\mathbf{19}^{I}$–$\mathbf{19}^{IV}$ are associated with separating knives $\mathbf{31}^{I}$–$\mathbf{3}^{IV}$ The working direction of the cleaner is designated at G. The pressure sensors 24*a*–24*h* and the settable air guiding elements $\mathbf{22}^{I}$–$\mathbf{22}^{IV}$ are connected to an electronic control and regulating device, for example, a microcomputer, as shown in FIG. 3.

It will be understood that the above description of the present invention is susceptible to various modifications, changes and adaptations, and the same are intended to be comprehended within the meaning and range of equivalents of the appended claims.

What is claimed is:

1. A fiber processing machine comprising:

(a) a roll having a direction of rotation and a clothing for carrying thereon fiber material upon rotation of said roll;

(b) a cover at least partially circumferentially extending about said roll;

(c) an air passage opening provided in said cover;

(d) an air guiding element bordering said air passage opening;

(e) a support for movably holding said air guiding element for varying a distance between said roll and said air guiding element;

(f) a pressure sensor for measuring a static pressure between said cover and said roll; and (g) setting means for setting a position of said air guiding element as a function of the pressure measured by said pressure sensor.

2. The fiber processing machine as defined in claim 1, wherein said setting means comprises:

(a) a transducer connected to said pressure sensor for converting pressure signals into electric signals;

(b) a regulating device connected to said transducer for receiving said electric signals therefrom;

(c) a nominal value setter connected to said regulating device; and (d) a motor connected to said regulating device and said air guiding element for moving said air guiding element as a functions of signals applied to said motor by said regulating device.

3. The fiber processing machine as defined in claim 1, wherein said support comprises means for rotatably holding said air guiding element in said cover at an end of said air guiding element.

4. The fiber processing machine as defined in claim 1, wherein said fiber processing machine is a carding machine having a licker-in constituting said roll.

5. The fiber processing machine as defined in claim 1, wherein said fiber processing machine is a carding machine having a main carding cylinder constituting said roll.

6. The fiber processing machine as defined in claim 1, wherein said fiber processing machine is a fiber cleaner and further wherein said roll forms part of said cleaner.

7. The fiber processing machine as defined in claim 1, wherein said air guiding element borders an upstream end of said air passage opening as viewed in said direction of rotation, further comprising a waste separating element bordering a downstream end of said air passage opening.

8. The fiber processing machine as defined in claim 1 further comprising a stationary carding element cooperating with the clothing of said roll; said stationary carding element being disposed circumferentially adjacent said air guiding element.

9. The fiber processing machine as defined in claim 1, further comprising means for guiding air exiting from between said cover and said roll through said air passage opening to a location of underpressure.

10. The fiber processing machine as defined in claim 1, further comprising means for guiding air exiting from between said cover and said roll through said air passage opening to a suction duct.

* * * * *